US011046096B2

(12) United States Patent
Hochi

(10) Patent No.: US 11,046,096 B2
(45) Date of Patent: Jun. 29, 2021

(54) ADJUSTMENT SHEET AND METHOD FOR ADJUSTING LANDING POSITION OF DROPLET

(71) Applicant: SEIKO EPSON CORPORATION, Tokyo (JP)

(72) Inventor: Hiroya Hochi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/550,794

(22) Filed: Aug. 26, 2019

(65) Prior Publication Data

US 2020/0070547 A1 Mar. 5, 2020

(30) Foreign Application Priority Data

Aug. 29, 2018 (JP) ..... JP2018-160035

(51) Int. Cl.

| | |
|---|---|
| ***B41J 11/42*** | (2006.01) |
| ***B41J 11/00*** | (2006.01) |
| ***B41J 2/21*** | (2006.01) |
| ***B41J 19/14*** | (2006.01) |

(52) U.S. Cl.

CPC ..... *B41J 11/42* (2013.01); *B41J 2/2135* (2013.01); *B41J 11/008* (2013.01); *B41J 19/145* (2013.01)

(58) Field of Classification Search

CPC ..... B41J 11/42; B41J 2/2135; B41J 19/145; B41J 11/008

See application file for complete search history.

(56) References Cited

U.S. PATENT DOCUMENTS

2013/0194327 A1* 8/2013 Hara ..... B41J 2/2128 347/7
2016/0277610 A1* 9/2016 Kishi ..... H04N 1/00737

FOREIGN PATENT DOCUMENTS

JP 2013-031969 A 2/2013

* cited by examiner

*Primary Examiner* — Yaovi M Ameh
(74) *Attorney, Agent, or Firm* — Workman Nydegger

(57) ABSTRACT

When an adjustment sheet is set on a recording surface of a medium, the adjustment sheet is transported together with the medium in a transport direction by a transport unit of a recording device. The adjustment sheet includes a first surface that contacts the recording surface, and a second surface that is a surface located opposite to the first surface and includes an adjustment region being a region in which an adjustment pattern detectable by a detection unit of the recording device is formed. A prescribed pattern has been formed in a region different from the adjustment region on the second surface.

12 Claims, 5 Drawing Sheets

ADJUSTMENT SHEET AND METHOD FOR ADJUSTING LANDING POSITION OF DROPLET

The present application is based on, and claims priority from JP Application Serial Number 2018-160035, filed Aug. 29, 2018, the disclosure of which is hereby incorporated by reference herein in its entirety.

BACKGROUND

1. Technical Field

The present disclosure relates to an adjustment sheet used in a recording device such as an ink-jet type printer, and a method for adjusting a landing position of a liquid droplet on a medium in the recording device using the same adjustment sheet.

2. Related Art

JP-A-2013-31969 describes one example of an image forming device that records a test chart on a sheet transported by a transport belt and reads the test chart recorded on the sheet by an optical sensor. In this image forming device, correction processing of correcting a discharge timing of an ink droplet by a recording head is performed based on the result of reading the test chart by the optical sensor.

In recording devices, recording processing is performed on various types of media. The medium to be recorded includes media in which wrinkling and cockling are more likely to be generated when ink adheres, and media in which wrinkling and cockling are less likely to be generated even when ink adheres.

For example, when a test chart is recorded on a medium in which wrinkling and cockling are less likely to be generated and the correction processing as described above is performed, wrinkling and cockling are hardly generated in the medium even when ink adheres to the medium for recording the test chart. In this way, highly accurate correction can be performed by the correction processing.

On the other hand, when a test chart is recorded on a medium where wrinkling and cockling are more likely to be generated and the correction processing as described above is performed, wrinkling and cockling may be generated in the medium when ink adheres to the medium for recording the test chart. When wrinkling or cockling are generated in the medium, the lines constituting the test chart may be distorted. Even in a case where such distorted lines are read by the optical sensor and the correction processing is performed, it is difficult to say that the correction accuracy of such correction processing is high.

In other words, correction accuracy of the correction processing may vary depending on the type of medium on which a test chart is recorded for performing the correction processing.

SUMMARY

An adjustment sheet that solves the above-described problem is an adjustment sheet used in a recording device. The recording device includes a transport unit configured to transport a medium in a transport direction, a discharge unit configured to discharge a liquid droplet on a recording surface of the medium transported by the transport unit, and a detection unit configured to detect an image formed on the recording surface of the medium transported by the transport unit. The adjustment sheet is configured to be transported, when the adjustment sheet is set on the recording surface of the medium, together with the medium in the transport direction by the transport unit. The adjustment sheet includes a first surface configured to contact the recording surface, and a second surface that is a surface located on a side opposite to the first surface and that includes an adjustment region being a region configured to be formed with an adjustment pattern detectable by the detection unit. A prescribed pattern has been formed in a region different from the adjustment region on the second surface.

Further, an adjusting method of a landing position of a liquid droplet includes: providing a recording device comprising a transport unit configured to transport a medium, a discharge unit configured to discharge a liquid droplet on the medium transported by the transport unit while the discharge unit moves in scanning directions intersecting a transport direction of the medium in the transport unit, and a detection unit configured to detect an image formed on the recording surface of the medium while the detection unit moves in the scanning directions; setting the adjustment sheet described above on the medium; forming, after the first step, the adjustment pattern including a forward direction pattern formed by discharging, on the adjustment region of the adjustment sheet transported together with the medium in the transport direction by the transport unit, a liquid droplet from the discharge unit while the discharge unit moves in a forward direction of the scanning directions, and a return direction pattern formed by discharging, on the adjustment region of the adjustment sheet, a liquid droplet from the discharge unit while the discharge unit moves in a return direction of the scanning directions; reading, after forming the adjustment pattern, the adjustment pattern by the detection unit; and calculating, after reading the adjustment pattern, a correction value for an adjustment of a discharge timing of a liquid droplet from the discharge unit based on the forward direction pattern and the return direction pattern.

DESCRIPTION OF EXEMPLARY EMBODIMENTS

One exemplary embodiment of an adjustment sheet and a method for adjusting a landing position of a liquid droplet will be described below according to FIGS. 1 to 8.

Figure 1:
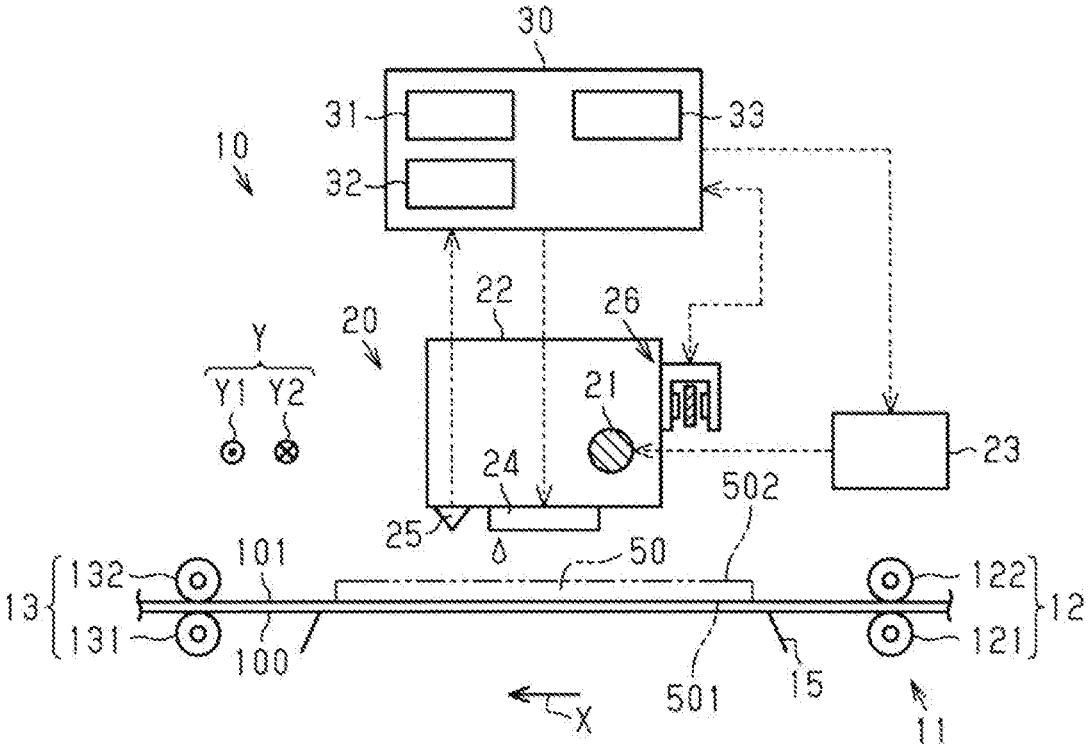
FIG. 1 is a diagram schematically illustrating a recording device in which an adjustment sheet according to an exemplary embodiment is used.
Figure 2:
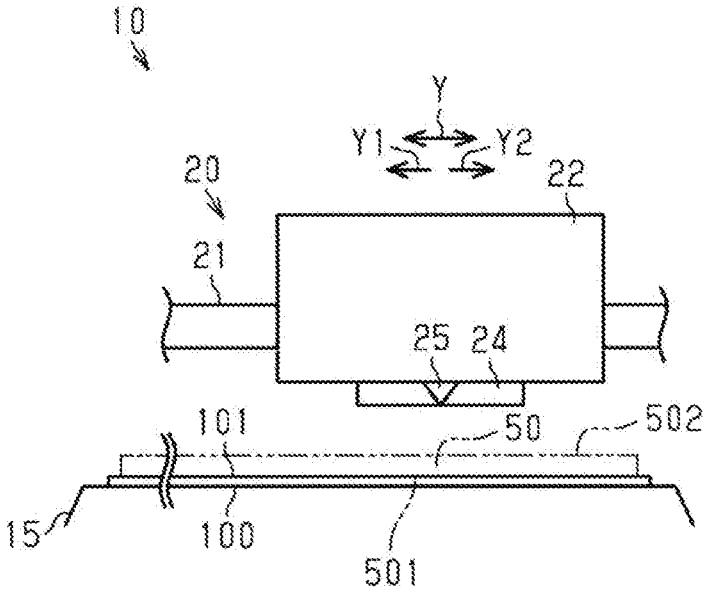
FIG. 2 is a diagram schematically illustrating the recording device in which an adjustment sheet according to an exemplary embodiment is used.

A recording device 10 in which an adjustment sheet 50 in the exemplary embodiment is used is illustrated in FIGS. 1 and 2. The recording device 10 includes a transport unit 11 that transports a medium 100 to be recorded in a predetermined transport direction X, and a recording unit 20 that forms an image on the medium 100 transported by the transport unit 11. The recording device 10 further includes a support table 15 that supports a portion of the medium 100 where recording is performed by the recording unit 20.

The transport unit 11 can transport various types of the media 100 having different thicknesses and sizes. The transport unit 11 includes a first transport roller pair 12 disposed upstream of the support table 15 in the transport direction X, and a second transport roller pair 13 disposed downstream of the support table 15 in the transport direction X. The first transfer roller pair 12 includes a first driving roller 121 to which power is transmitted from a power source, such as a motor, and a first driven roller 122 that sandwiches the medium 100 with the first driving roller 121. The second transfer roller pair 13 includes a second driving roller 131 to which power is transmitted from a power source, such as a motor, and a second driven roller 132 that sandwiches the medium 100 with the second driving roller 131.

The recording unit 20 includes a guide member 21 extending in a direction intersecting the transport direction X among directions along a recording surface 101 of the medium 100 transported by the transport unit 11, and a carriage 22 supported by the guide member 21. The carriage 22 is supported by the guide member 21 in a state where the carriage 22 is movable in the extending direction of the guide member 21. Further, a driving force of a carriage motor 23 is transmitted to the carriage 22. Then, the carriage 22 moves in the extending direction of the guide member 21 by driving of the carriage motor 23.

Note that a direction in which the carriage 22 moves is referred to as a scanning direction Y. The scanning direction Y intersects the transport direction X among directions along the recording surface 101 of the medium 100 transported by the transport unit 11. Further, one direction in the scanning direction Y may be referred to as a "forward direction Y1", and the other direction in the scanning direction Y may be referred to as a "return direction Y2". In other words, the return direction Y2 is a direction opposite to the forward direction Y1.

A recording head 24 and an optical sensor 25 are provided on the carriage 22. The recording head 24 discharges an ink droplet, which is one example of a liquid droplet, onto the recording surface 101 of the medium 100 supported by the support table 15. In other words, the recording head 24 functions as one example of a "discharge unit". Although not illustrated, the recording head 24 includes a plurality of nozzles that discharge ink droplets. More specifically, a nozzle row configured by aligning a plurality of nozzles in the transport direction X is formed in the recording head 24.

The optical sensor 25 outputs light toward the recording surface 101 of the medium 100 supported by the support table 15, and also receives reflected light from the recording surface 101. The amount of reception of reflected light by the optical sensor 25 varies depending on a density of ink that adheres to a portion of the recording surface 101 where the output light is incident. In this way, the optical sensor 25 can detect an image formed on the recording surface 101. Then, the optical sensor 25 outputs a signal according to the amount of reception of reflected light, that is, a signal according to a density of an image on the recording surface 101 to a control device 30, which is one example of a control unit. In other words, the optical sensor 25 functions as one example of a "detection unit". Then, the optical sensor 25 moves together with the carriage 22 in the scanning direction Y intersecting the transport direction X.

Further, a linear encoder 26 is provided on the recording unit 20. A detection signal of the linear encoder 26 is input to the control device 30. The control device 30 can detect a movement speed of the carriage 22 in the extending direction of the guide member 21, that is, in the scanning direction Y, based on the detection signal. The control device 30 can also determine whether the carriage 22 is moving in the forward direction Y1 or the carriage 22 is moving in the return direction Y2, based on the detection signal.

The control device 30 includes a CPU 31, a memory 32, and an ASIC 33. The ASIC 33 is an abbreviation for an "Application Specific IC". The memory 32 stores a program executed by the CPU 31, various maps, a computation result by the CPU 31, detection values by various sensors, and the like. Then, the control device 30 records an image on the recording surface 101 of the medium 100 by controlling the transport unit 11 and the recording unit 20.

As illustrated in FIGS. 1 and 2, the transport unit 11 can transport the adjustment sheet 50 set on the recording surface 101 of the medium 100 together with the medium 100 in the transport direction X. The adjustment sheet 50 is used for adjusting a landing position of a liquid droplet, adjusting the amount of transport and a transport speed of the medium 100 transported by the transport unit 11, and the like.

Figure 3:
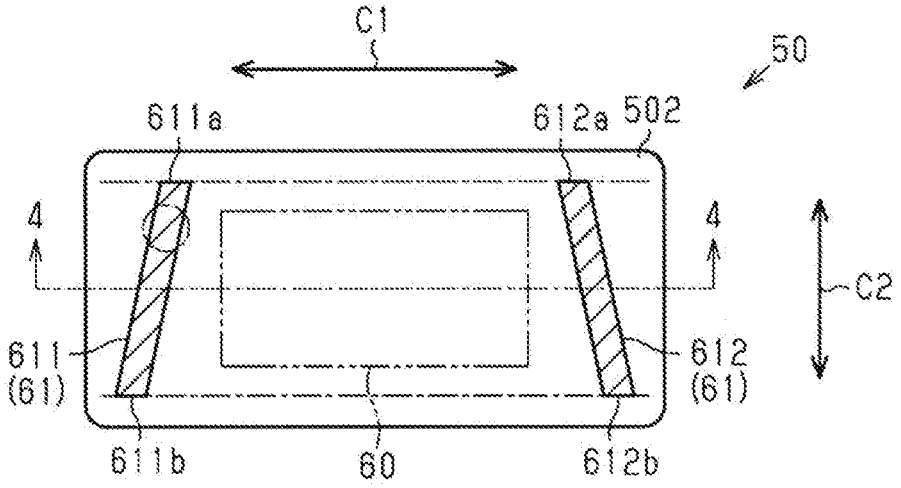
FIG. 3 is a plan view of an adjustment sheet.
Figure 4:
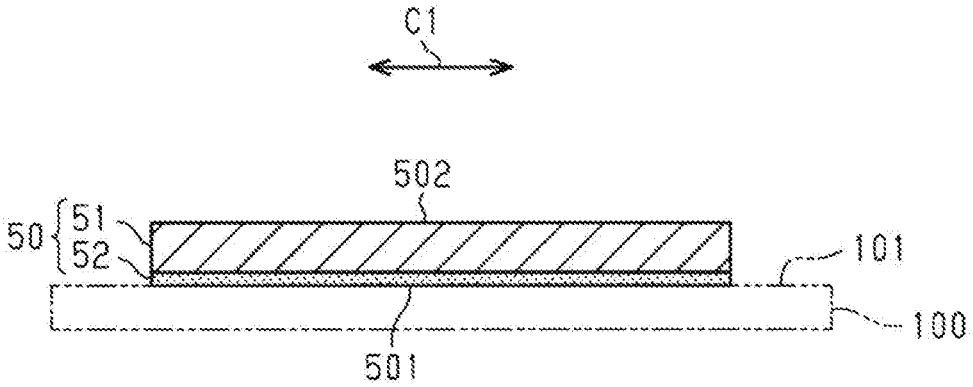
FIG. 4 is a cross-sectional view taken along a line 4-4 in FIG. 3.

As illustrated in FIGS. 3 and 4, the adjustment sheet 50 includes a body sheet 51 and an adhesive layer 52. The body sheet 51 is formed of a material in which wrinkling and cockling are less likely to be generated even when ink adheres. For example, a sheet having an ink receptive layer such as a photographic sheet can be adopted as the body sheet 51.

The adhesive layer 52 is provided on one surface of both surfaces of the body sheet 51. By pressing the adhesive layer 52 against the medium 100, the adjustment sheet 50 can be attached to the medium 100.

In the exemplary embodiment, an outermost surface of the adhesive layer 52 functions as a "first surface 501" that contacts the recording surface 101 of the medium 100 as illustrated in FIGS. 1 and 2. Further, a surface of both surfaces of the body sheet 51 on which the adhesive layer 52 is not provided functions as a "second surface 502" as illustrated in FIGS. 1 and 2. Therefore, it can be said that the adhesive layer 52 is provided on a surface of the body sheet 51 opposite to the second surface 502.

As indicated by a chain double-dashed line in FIG. 3, an adjustment region 60 is prepared on the second surface 502 of the adjustment sheet 50, and is a region where an adjustment pattern is formed when a landing position of a liquid droplet is adjusted and a transport speed of the medium 100 transported by the transport unit 11 is adjusted. The adjustment pattern is a pattern formed by landing an ink droplet from the recording head 24 onto the adjustment sheet 50, and is detectable by the optical sensor 25.

Figure 5:
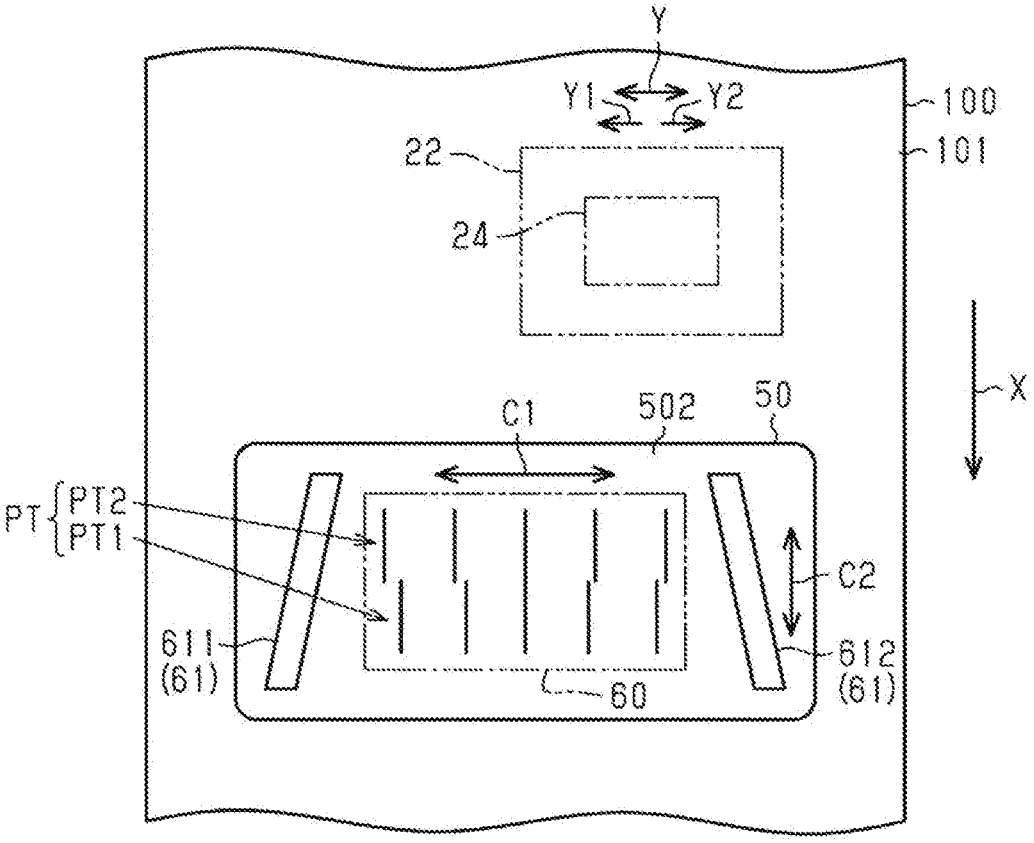
FIG. 5 is an action diagram illustrating a situation where an adjustment pattern is recorded in an adjustment region of the adjustment sheet set on a medium.

Note that FIG. 5 illustrates one example of a case where an adjustment pattern PT for adjusting a landing position of a liquid droplet is formed in the adjustment region 60. The adjustment pattern PT includes a forward direction pattern PT1 and a return direction pattern PT2. The forward direction pattern PT1 is a pattern formed by discharging an ink droplet from the recording head 24 while moving the carriage 22 and the recording head 24 in the forward direction Y1. The return direction pattern PT2 is a pattern formed by discharging an ink droplet from the recording head 24 while moving the carriage 22 and the recording head 24 in the return direction Y2.

Further, as illustrated in FIG. 3, a prescribed pattern 61 has been formed in a region different from the adjustment region 60 on the second surface 502. In the exemplary embodiment, as the prescribed pattern 61, a first prescribed pattern 611 and a second prescribed pattern 612 disposed in a position different from that of the first prescribed pattern 611 have been formed on the second surface 502.

A direction in which the first prescribed pattern 611 and the second prescribed pattern 612 are aligned among directions along the second surface 502 is referred to as a first direction C1, and a direction orthogonal to the first direction C1 is referred to as a second direction C2. In this case, the adjustment region 60 is disposed between the first prescribed pattern 611 and the second prescribed pattern 612 in the first direction C1. In other words, it can be said that the second prescribed pattern 612 is provided in a position different from that of the first prescribed pattern 611 in the first direction C1.

The first prescribed pattern 611 and the second prescribed pattern 612 each extend in a direction intersecting the first direction C1 among directions along the second surface 502. Specifically, the first prescribed pattern 611 also extends in a direction intersecting the second direction C2, and the second prescribed pattern 612 also extends in a direction intersecting the second direction C2. Then, a gap between the first prescribed pattern 611 and the second prescribed pattern 612 in the first direction C1 gradually increases from one end toward the other end in the second direction C2.

Further, one end in the second direction C2 of the first prescribed pattern 611 is referred to as a first side one end 611*a*, and the other end in the second direction C2 of the first prescribed pattern 611 is referred to as a first side other end 611*b*. One end in the second direction C2 of the second prescribed pattern 612 is referred to as a second side one end 612*a*, and the other end in the second direction C2 of the second prescribed pattern 612 is referred to as a second side other end 612*b*. In this case, the first side one end 611*a* is disposed in the same position as that of the second side one end 612*a* in the second direction C2. Further, the first side other end 611*b* is disposed in the same position as that of the second side other end 612*b* in the second direction C2. In other words, in the exemplary embodiment, the first prescribed pattern 611 overlaps the second prescribed pattern 612 in the first direction C1.

Figure 6:
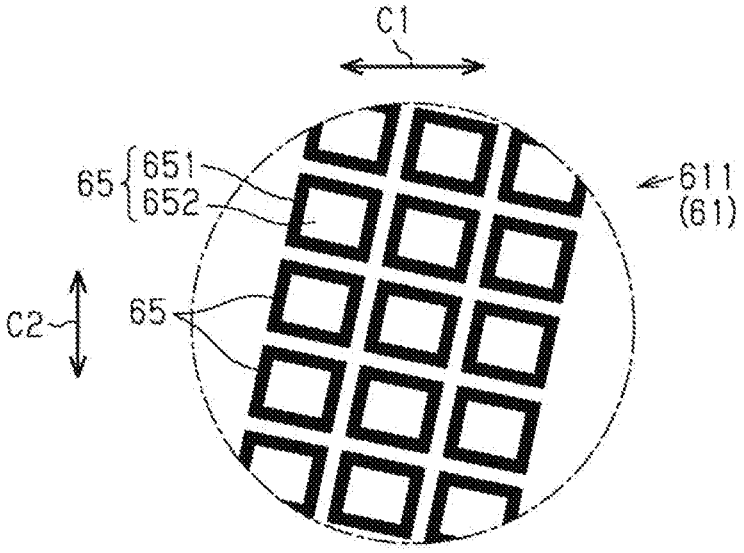
FIG. 6 is an enlarged view of a part of a first prescribed pattern of the adjustment sheet.

As illustrated in FIG. 6, the first prescribed pattern 611 is a collection of a plurality of marks 65. The marks 65 adjacent to each other are separated at regular intervals. The mark 65 is configured such that a first portion 651 and a second portion 652 having a density lower than that of the first portion 651 are adjacent to each other in the first direction C1. In the example illustrated in FIG. 6, the mark 65 includes the first portion 651 being a rectangular annular frame, and the second portion 652 inside the first portion 651. In other words, the first prescribed pattern 611 is configured such that the first portions 651 and the second portions 652 are aligned alternately in the first direction C1.

Note that the second prescribed pattern 612 is also a collection of the plurality of marks 65. In other words, the second prescribed pattern 612 is configured such that the first portions 651 and the second portions 652 are alternately aligned in the first direction C1. Note that the configuration of the second prescribed pattern 612 is the same as that of the first prescribed pattern 611, and thus a specific description thereof is omitted.

Next, an adjustment method according to the exemplary embodiment will be described with reference to FIG. 7.

Figure 7:
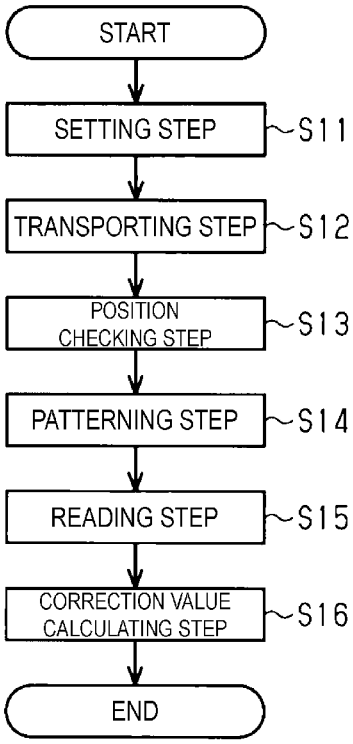
FIG. 7 is a flowchart for describing an adjustment method in the exemplary embodiment.

As illustrated in FIG. 7, in first step S11, a setting step of setting the adjustment sheet 50 on the recording surface 101 of the medium 100 is performed. In the setting step, the adjustment sheet 50 is attached to the recording surface 101 of the medium 100 on the upstream of the first transport roller pair 12 in the transport direction X. In the exemplary embodiment, step S11 corresponds to a "first step".

When the adjustment sheet 50 is set on the medium 100, the adjustment sheet 50 may be set on the medium 100 such that the first direction C1 of the adjustment sheet 50 matches the scanning direction Y of the carriage 22. Note that the adjustment sheet 50 may be set on the medium 100 in a state with the first direction C1 slightly offset with the scanning direction Y.

When the adjustment sheet 50 is set on medium 100, the processing proceeds to next step S12. In step S12, a transporting step is performed. In the transporting step, by driving the transport unit 11 by the control device 30, the medium 100 to which the adjustment sheet 50 is attached is transported in the transport direction X. In other words, the adjustment sheet 50 is transported together with the medium 100 in the transport direction X. Then, when the control device 30 confirms that a portion of the medium 100 where the adjustment sheet 50 is attached is supported by the support table 15, the transporting step is terminated.

Then, in next step S13, a position checking step is performed. In the position checking step, a position of the adjustment region 60 on the adjustment sheet 50 is checked. Specifically, in the position checking step, the first prescribed pattern 611 and the second prescribed pattern 612 that have been formed on the adjustment sheet 50 are detected by the optical sensor 25 provided on the carriage 22 while moving the carriage 22 in the scanning direction Y. Then, the control device 30 recognizes a position of the first prescribed pattern 611 and a position of the second prescribed pattern 612, based on a detection result of the optical sensor 25. By recognizing a position of the first prescribed pattern 611 and a position of the second prescribed pattern 612 in this way, the control device 30 can check a position of the adjustment region 60, that is, a position where the adjustment pattern PT is to be formed. Then, when the position of the adjustment region 60 is checked by the control device 30, the position checking step is terminated.

Next, in step S14, a patterning step is performed. In the patterning step, the adjustment pattern PT is formed in the adjustment region 60 of the adjustment sheet 50 by driving the recording unit 20 and the transport unit 11. Specifically, by discharging an ink droplet from the recording head 24 while moving the carriage 22 in the forward direction Y1 by the control device 30, the forward direction pattern PT1 of the adjustment pattern PT is formed in the adjustment region 60. When the formation of the forward direction pattern PT1 is completed, the return direction pattern PT2 of the adjustment pattern PT is formed in the adjustment region 60 by discharging an ink droplet from the recording head 24 while moving the carriage 22 in the return direction Y2 by the control device 30. When the formation of the return direction pattern PT2 is completed, it can be determined that the formation of the adjustment pattern PT in the adjustment region 60 is completed, and thus the patterning step is terminated. In the exemplary embodiment, step S14 corresponds to a "second step".

Then, in a next step S15, a reading step is performed. In the reading step, by moving the carriage 22 in the scanning direction Y by the control device 30, the optical sensor 25 reads the forward direction pattern PT1 and the return direction pattern PT2 formed in the adjustment region 60. In the exemplary embodiment, step S15 corresponds to a "third step" of reading the adjustment pattern PT after the second step. Then, when reading of the forward direction pattern PT1 and the return direction pattern PT2 is completed, the reading step is terminated.

Next, in step S16, a correction value calculating step is performed. In the correction value calculating step, a correction value for an adjustment of a discharge timing of an ink droplet of the recording head 24 during recording is derived based on the information read in the reading step. In the exemplary embodiment, step S16 corresponds to a "fourth step".

The amount of deviation between a landing position on the adjustment sheet 50 when the recording head 24 discharges an ink droplet while moving in the forward direction Y1 and a landing position on the adjustment sheet 50 when the recording head 24 discharges an ink droplet while moving in the return direction Y2 also varies depending on a gap between the recording head 24 and the second surface 502 of the adjustment sheet 50. In other words, in the exemplary embodiment, the adjustment pattern PT is formed on the adjustment sheet 50 attached to the medium 100, and the correction value is derived by using the adjustment pattern PT formed on the adjustment sheet 50.

Here, in the exemplary embodiment, the correction value is derived while taking into account a thickness of the adjustment sheet 50. In other words, an offset value Q of a thickness of the adjustment sheet 50 is calculated by using the following relational expression (Equation 1). Note that, in the relational expression (Equation 1), "Vcr" is a movement speed of the carriage 22 and the recording head 24, "Vd" is a speed of an ink droplet, and "D" is a thickness of the adjustment sheet 50. Information about the adjustment sheet 50 is stored in advance in the memory 32 of the control device 30. In other words, the thickness D of the adjustment sheet 50 is stored in the memory 32.

[Mathematical Equation 1]

$$Q = \frac{2 \cdot Vcr}{Vd} \cdot D \qquad \text{(Equation 1)}$$

When the derivation of the correction value is completed, the correction value calculating step is terminated. Then, the adjustment method in the exemplary embodiment illustrated in FIG. 7 is terminated.

Note that, in the correction value calculating step, in addition to the correction value based on the thickness D of the adjustment sheet 50, a correction value taking into account an influence of air resistance may be calculated, and an offset value based on each of these correction values may be stored in the memory 32. A distance between a nozzle surface of the recording head 24 in which each of the nozzles is opened and the recording surface of the medium to be recorded is shortened when the adjustment sheet 50 is attached to the medium 100, and the distance increases when the adjustment sheet 50 is removed from the medium 100. An influence of air resistance on an ink droplet increases as the above-described distance increases. In other words, a greater range of an ink droplet is more likely to cause a greater landing deviation of the ink droplet onto the adjustment sheet 50 and the medium 100 due to the air resistance.

Therefore, the adjustment pattern PT formed on the adjustment sheet 50 attached to the medium 100 may differ from an adjustment pattern formed directly on the medium 100 due to a difference in degree of an influence of the air resistance on the ink droplet. In this case, a distance between the nozzle surface and the second surface 502 is calculated by subtracting the thickness D of the adjustment sheet 50 from a distance between the recording surface 101 and the nozzle surface. Further, a relationship between the distance between the nozzle surface and the second surface 502 and the landing deviation of the ink droplet due to the air resistance is evaluated in advance based on the movement speed Vcr of the carriage 22 and the recording head 24 and the speed Vd of the ink droplet. The relationship between the distance between the nozzle surface and the second surface 502 and the landing deviation of the ink droplet due to the air resistance can be derived in advance by a simulation, experiments, or the like. When a plurality of types of adjustment sheets 50 are present, each of the adjustment sheets 50 is evaluated. Then, a relationship between the thickness D of the evaluated adjustment sheet 50 and the influence of the air resistance is stored in the memory 32, the relationship between the thickness D of the adjustment sheet 50 and the influence of the air resistance is read as reference data according to a type of the adjustment sheet 50 to be used, and a correction value is calculated based on the reference data.

Next, the action and the effects of the exemplary embodiment will be described.

(1) By setting the adjustment sheet 50 on the medium 100 such that the first surface 501 contacts the recording surface 101 of the medium 100, the recording device 10 can transport the adjustment sheet 50 together with the medium 100 in the transport direction X. As a result, the second surface 502 of the adjustment sheet 50 can face the recording head 24. In this way, the prescribed pattern 61 that has been formed on the second surface 502 can be detected by the optical sensor 25 of the recording device 10. In other words, whether or not setting of the adjustment sheet 50 on the medium 100 is forgotten can be determined by the control device 30 of the recording device 10 depending on whether or not the prescribed pattern 61 has been detected by the optical sensor 25.

Then, in a state where the adjustment sheet 50 is set on the medium 100, the adjustment pattern PT can be formed in the adjustment region 60 of the adjustment sheet 50 by discharging an ink droplet from the recording head 24. Then, the adjustment pattern PT formed in the adjustment region 60 is read by the recording device 10 side, and thus the recording device 10 can be caused to perform correction using this adjustment pattern PT.

Here, when the adjustment pattern PT is recorded on the adjustment sheet 50, an ink droplet discharged from the recording head 24 lands on the adjustment sheet 50. Then, by landing the ink droplet onto the adjustment sheet 50, wrinkling and cockling may also be generated in the adjustment sheet 50.

It is assumed that the adjustment pattern PT is formed on the medium 100. In this case, in a case where the medium 100 is prone to wrinkling and cockling due to the adhesion of the ink, wrinkling and cockling may be generated in the medium 100 by recording the adjustment pattern PT on the medium 100. Specifically, even in a case where wrinkling and cockling are not generated in the medium 100 immediately after the ink adheres to the medium 100, wrinkles and cockling may be generated over time in the medium 100. Then, when wrinkling and cockling are generated in the medium 100 at a timing at which the adjustment pattern PT is read by the optical sensor 25, lines constituting the adjustment pattern PT are distorted on the recording surface 101, and accuracy of detecting the adjustment pattern PT by the optical sensor 25 may decrease. When the accuracy of detecting the adjustment pattern PT is low, correction accuracy may decrease.

Note that, depending on a type of ink and the medium 100, wrinkling and cockling generated in the medium 100 may be reduced when the ink is dried. In this case, a reading operation of the optical sensor 25 may be made to wait until the ink dries, but the time for drying the ink depends on the type of ink and the medium 100. For example, a longer time required for drying the ink also increases a waiting time, which reduces throughput.

In this regard, in the exemplary embodiment, for correction, the adjustment pattern PT is recorded on the adjustment sheet 50 instead of the medium 100. In this case, a generation aspect of wrinkling and cockling due to the adhesion of the ink to the adjustment sheet 50 is determined by characteristics of the adjustment sheet 50. In this way, variations in the generation aspect of wrinkling and cockling in a sheet used for correction are suppressed. Therefore, variations in correction accuracy due to a type of the sheet on which the adjustment pattern PT is formed can be suppressed. Further, since there is no need to wait until wrinkling and cockling generated in the medium 100 is reduced, a decrease in throughput can be suppressed.

(2) It is also conceivable that the prescribed pattern is a single thick line. In this case, it is difficult to distinguish the prescribed pattern from a line that had been formed on the second surface 502 of the adjustment sheet 50 apart from the prescribed pattern. In this regard, in the exemplary embodiment, the prescribed pattern 61 including the first portion 651 and the second portion 652 having different densities from each other has been formed on the second surface 502. Therefore, by using the optical sensor 25 of the recording device 10, even when a line has been formed on the second surface 502 in addition to the prescribed pattern 61, the line different from the prescribed pattern 61 is easily distinguished from the prescribed pattern 61.

(3) The prescribed pattern 61 extends in the direction intersecting the first direction C1 among directions along the second surface 502. It is assumed that the adjustment sheet 50 is set on the medium 100 such that the scanning direction Y of the optical sensor 25 substantially matches the first direction C1, and in this state, the adjustment sheet 50 is transported together with the medium 100 in the transport direction X. In the exemplary embodiment, when the adjustment sheet 50 is transported together with the medium 100 in the transport direction X, a direction in which the prescribed pattern 61 extends includes a component of the transport direction X. In this way, the prescribed pattern 61 can be continuously read by the optical sensor 25 even while the medium 100 is transported in the transport direction X. Therefore, an occurrence of a detection error such that the prescribed pattern 61 cannot be read by the optical sensor 25 can be suppressed in comparison to a case where the prescribed pattern 61 is interrupted partway. Note that, in this case, an interval between the first portion 651 and the second portion 652 being aligned in a direction intersecting the first direction C1 may be less than or equal to a detection resolution of the optical sensor 25. In this way, when the optical sensor 25 detects the prescribed pattern 61, the recording device 10 can recognize that the first portion 651 and the second portion 652 are continuous, and thus an effect of suppressing the occurrence of the detection error described above can be increased.

Figure 8:
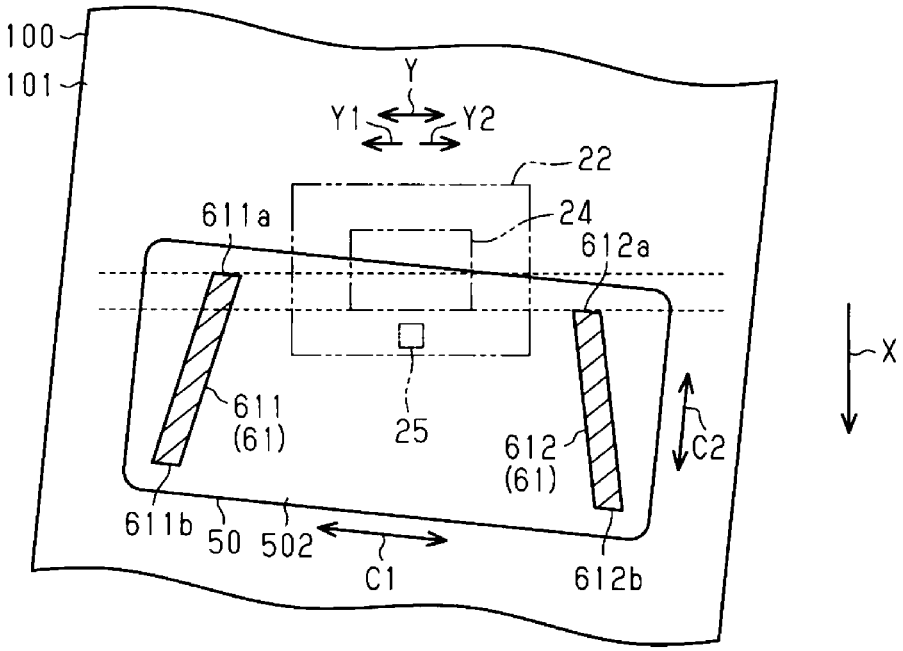
FIG. 8 is an action diagram illustrating a situation where the medium is slanted.

(4) Even when the adjustment sheet 50 is set on the medium 100 such that the scanning direction Y substantially matches the first direction C1, the medium 100 may be slanted during transport as illustrated in FIG. 8. In this regard, in the exemplary embodiment, the first prescribed pattern 611 and the second prescribed pattern 612 have been formed as the prescribed pattern 61 on the second surface 502 of the adjustment sheet 50. Then, the first side one end 611*a* is disposed in the same position as that of the second side one end 612*a* in the second direction C2. Further, the first side other end 611*b* is disposed in the same position as that of the second side other end 612*b* in the second direction C2. For example, when the medium 100 is slanted, one pattern of the first prescribed pattern 611 and the second prescribed pattern 612 can be read by the optical sensor 25 that moves in the scanning direction Y, but the other pattern may not be able to be read. In the example illustrated in FIG. 8, in a region surrounded by broken lines, the first prescribed pattern 611 can be read by the optical sensor 25 while the second prescribed pattern 612 cannot be read by the optical sensor 25. In such a case, whether or not the medium 100 is slanted can be determined through reading of the prescribed pattern 61 by the optical sensor 25.

Note that, in the exemplary embodiment, in the first direction C1, the first prescribed pattern 611 is located farther toward one side than the adjustment region 60, and the second prescribed pattern 612 is located farther toward the other side than the adjustment region 60. In other words, the first prescribed pattern 611 is disposed away from the second prescribed pattern 612 in the adjustment sheet 50. For example, when the first prescribed pattern 611 is located closer to the second prescribed pattern as in a case where both of the first prescribed pattern 611 and the second prescribed pattern 612 are located farther toward one side in the first direction C1 than the adjustment region 60, the first side one end 611*a* is located closer to the second side one end 612*a*. In this case, the first side one end 611*a* and the second side one end 612*a* may both enter a detection range of the optical sensor 25. As a result, even though the medium 100 is slanted, both of the first side one end 611*a* and the second side one end 612*a* are detected by the optical sensor 25, and it may not be possible to detect that the medium 100 is slanted.

In contrast, in the exemplary embodiment, in the first direction C1, the first prescribed pattern 611 is located farther toward one side than the adjustment region 60, and the second prescribed pattern 612 is located farther toward the other side than the adjustment region 60. In other words, the first side one end 611*a* is located away from the second side one end 612*a* by a range of the adjustment region 60 in the first direction C1. In this way, when the adjustment sheet 50 is attached to the medium 100, the first side one end 611*a* is offset with respect to the second side one end 612*a* in the transport direction X, and the second side one end 612*a* falls outside the detection range of the optical sensor 25 when the optical sensor 25 detects the first side one end 611*a* and then reaches near the second side one end 612*a*. In other words, by adopting the configuration of the exemplary embodiment, when the medium 100 is slanted, a state where one of the first prescribed pattern 611 and the second prescribed pattern 612 is read and the other of the first prescribed pattern 611 and the second prescribed pattern 612 is not read is more likely to be achieved. Therefore, accuracy of determining whether or not the medium 100 on which the adjustment sheet 50 is set is slanted can be increased as described above.

(5) In the exemplary embodiment, a distance between the first prescribed pattern 611 and the second prescribed pattern 612 in the first direction C1 varies in the second direction C2. In this way, a gap between the first prescribed pattern 611 and the second prescribed pattern 612 detected by the recording device 10 gradually changes as the adjustment sheet 50 is transported together with the medium 100. Thus, by monitoring the above-described gap changing in such a manner, the amount of transport and a transport speed of the medium 100 and the adjustment sheet 50 transported by the transport unit 11 can be estimated. For example, by recognizing a current amount of transport of the medium 100 is being transported, a discharge timing of an ink droplet can be optimized according to the amount of transport, and the adjustment pattern PT can be formed according to the amount of transport. Therefore, a correspondence between the amount of transport and the adjustment pattern PT can be produced with higher accuracy.

(6) On the second surface 502 of the adjustment sheet 50, the adjustment region 60 is provided between the first prescribed pattern 611 and the second prescribed pattern 612 in the first direction C1. In this way, the recording device 10 side recognizes a position of the first prescribed pattern 611 and a position of the second prescribed pattern 612 in the first direction C1, and thus the recording device 10 side can recognize a position of the adjustment region 60 in the first direction C1. As a result, formation of the adjustment pattern PT in a position different from that of the adjustment region 60 can be suppressed.

(7) The adjustment pattern PT including the forward direction pattern PT1 and the return direction pattern PT2 is formed in the adjustment region 60 of the adjustment sheet 50 set on the medium 100. In this way, a correction value for an adjustment of a discharge timing of an ink droplet of the recording head 24 can be derived based on the forward direction pattern PT1 and the return direction pattern PT2. Then, the discharge timing of the ink droplet by the recording head 24 is controlled by using the derived correction value, and thus a quality of an image formed on the medium 100 can be increased.

(8) Note that the correction value is derived while taking into account the thickness D of the adjustment sheet 50. Then, the discharge timing of the ink droplet by the recording head 24 is controlled by using the correction value with consideration given to the thickness D of the adjustment sheet 50, and thus the quality of an image that will be formed on the medium 100 can be increased.

The exemplary embodiment described above may be modified as follows. The exemplary embodiment described above and the modified examples below may be implemented in combination within a range in which a technical contradiction does not arise.

In a case where the adjustment sheet 50 can be transported together with the medium 100 by setting the adjustment sheet 50 on the medium 100, an adhesive layer may not be provided on the adjustment sheet 50. For example, the adjustment sheet 50 may be attached to the medium 100 by static electricity, or the adjustment sheet 50 may be set on the medium 100 by using a permanent magnet or an electromagnet. In particular, when a permanent magnet and an electromagnet are used, the adjustment sheet 50 may be configured to contain a magnetic metal such as iron, cobalt, and the like.

In a case where the adjustment region 60 is provided on the second surface 502 of the adjustment sheet 50, the adjustment region 60 may be provided at a location other than a location between the first prescribed pattern 611 and the second prescribed pattern.

In a case where a gap between the first prescribed pattern 611 and the second prescribed pattern 612 changes from one end toward the other end in the second direction C2, the extending direction of any one pattern of the first prescribed pattern 611 and the second prescribed pattern 612 may be the second direction C2.

The first prescribed pattern 611 and the second prescribed pattern 612 might have been formed such that a gap between the first prescribed pattern 611 and the second prescribed pattern 612 gradually narrows from one end to an intermediate point in the second direction C2, and the gap between the first prescribed pattern 611 and the second prescribed pattern 612 increases from the intermediate point toward the other end.

Both of the first prescribed pattern 611 and the second prescribed pattern 612 may extend in the second direction C2.

In a case where at least a part of the first prescribed pattern 611 overlaps the second prescribed pattern 612 in the first direction C1, the first side one end 611*a* of the first prescribed pattern 611 may not be located in the same position as that of the second side one end 612*a* of the second prescribed pattern 612 in the second direction C2.

In a case where at least a part of the first prescribed pattern 611 overlaps the second prescribed pattern 612 in the first direction C1, the first side other end 611*b* of the first prescribed pattern 611 may not be located in the same position as that of the second side other end 612*b* of the second prescribed pattern 612 in the second direction C2.

In the exemplary embodiment described above, the design of the first prescribed pattern 611 is the same as the design of the second prescribed pattern 612. However, the design of the first prescribed pattern 611 may be different from the design of the second prescribed pattern 612.

The first prescribed pattern 611 may not be a pattern as illustrated in FIG. 6 as long as the first portion 651 having a high density and the second portion 652 having a density lower than that of the first portion 651 are adjacent to each other in the first direction C1. For example, the first prescribed pattern 611 may have a shape in which a plurality of lines extending in one direction are aligned in the first direction C1 with an interval between the lines.

The second prescribed pattern 612 may not be a pattern as illustrated in FIG. 6 as long as the first portion 651 having a high density and the second portion 652 having a density lower than that of the first portion 651 are adjacent to each other in the first direction C1. For example, the second prescribed pattern 612 may have a shape in which a plurality of lines extending in one direction are aligned in the first direction C1 with an interval between the lines.

The first prescribed pattern 611 may be a single thick line.

The second prescribed pattern 612 may be a single thick line.

A prescribed pattern that has been formed on the adjustment sheet 50 may be only one of the first prescribed pattern 611 and the second prescribed pattern 612.

The prescribed pattern may not be a pattern extending in an arbitrary direction as long as the pattern can be detected by the optical sensor 25. For example, the prescribed pattern may be constituted by a single mark such as a circle or a square.

The adjustment sheet 50 may be used during another adjustment other than an adjustment of a landing position. Examples of another adjustment may include an adjustment of the amount of transport of the medium 100 transported by the transport unit 11. In one transport processing, the amount of transport is controlled based on the amount of rotation of a rotating roller during transport of the medium 100. In other words, in a case where the center of rotation of the roller is eccentric, the amount of transport varies even with a constant amount of rotation of the roller. Thus, the adjustment pattern formed in the adjustment region 60 may be a pattern for checking a degree of variation in the amount of transport of the medium 100 transported by the transport unit 11.

Figure 9:
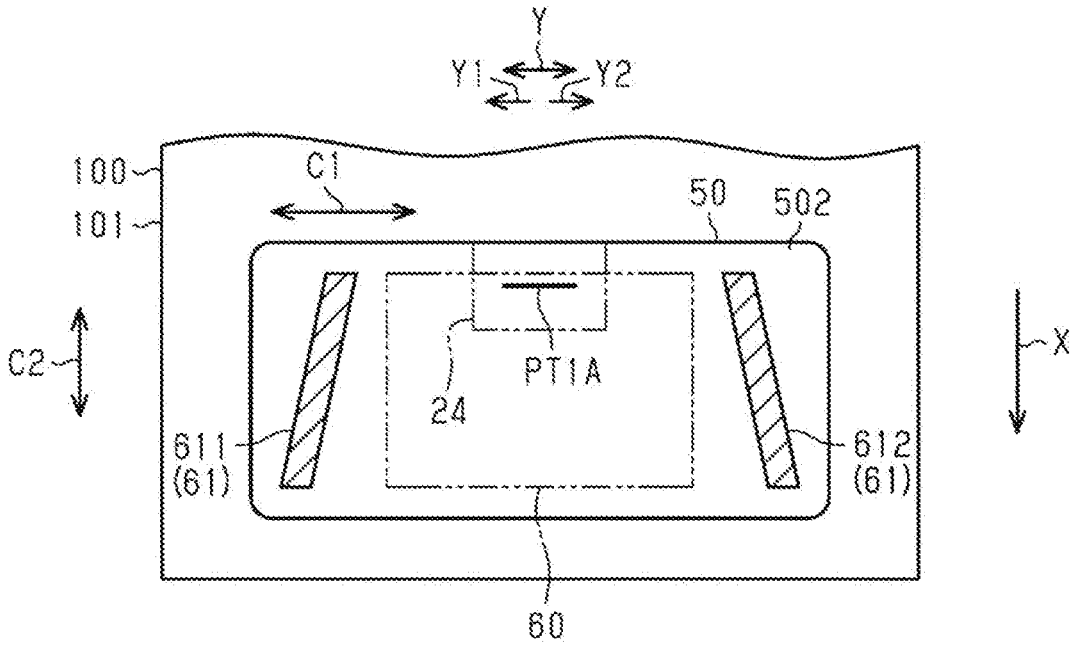
FIG. 9 is an action diagram illustrating a situation where an adjustment pattern for checking a degree of variation in the amount of transport of the medium transported by a transport unit is recorded on the adjustment sheet in a modified example.
Figure 10:
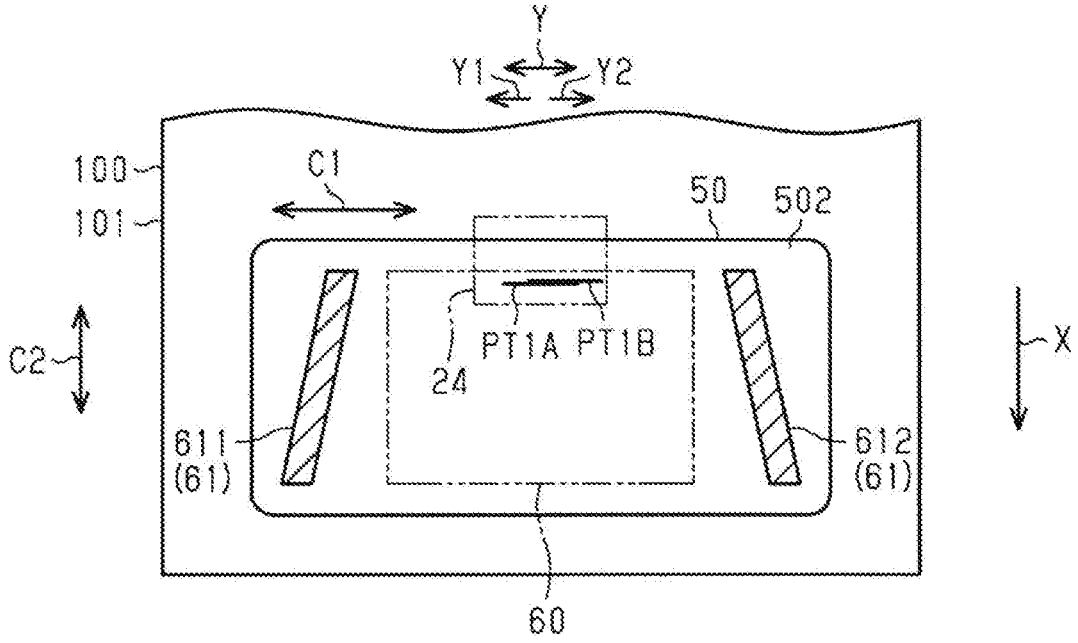
FIG. 10 is an action diagram illustrating a situation where an adjustment pattern for checking a degree of variation in the amount of transport of the medium transported by the transport unit is recorded on the adjustment sheet in a modified example.

FIGS. 9 and 10 illustrate one example of a method for forming an adjustment pattern for checking a degree of variation in the amount of transport of the medium 100 transported by the transport unit 11. First, as illustrated in FIG. 9, an adjustment pattern PT1A extending in the scanning direction Y is recorded in the adjustment region 60. Then, the roller is rotated by a predetermined amount to perform transport by a predetermined transport amount ΔX in the transport direction X. When the transport of the medium 100 is stopped, as illustrated in FIG. 10, a new adjustment pattern PT1B is recorded in the adjustment region 60 by using the nozzles downstream of the nozzles that record the adjustment pattern PT1A in the transport direction X. The nozzles that record the adjustment pattern PT1B are shifted downstream by a distance corresponding to the predetermined transport amount ΔX from the nozzles that record the adjustment pattern PT1A. At this time, when the roller is not eccentric and an actual amount of transport of the medium 100 is equal to the predetermined amount, the adjustment pattern PT1B is recorded such that the adjustment pattern PT1B overlaps the adjustment pattern PT1A.

In FIG. 10, the adjustment pattern PT1A deviates from the adjustment pattern PT1B in the transport direction X. The amount of transport can be corrected based on this amount of deviation.

Note that such an adjustment of the amount of transport of the medium 100 transported by the transport unit 11 can also be performed by the recording device 10 of a type that does not move the recording head 24 in the scanning direction Y. Therefore, the recording device in which the adjustment sheet 50 is used may be a recording device other than the serial scan type illustrated in FIGS. 1 and 2.

The recording device may be a fluid jet device that sprays and discharges liquids other than ink and performs recording. Examples of other liquids include liquids in which particles of a functional material are dispersed or mixed in a liquid, and a fluid like a gel.

Hereinafter, a technical idea derived from the exemplary embodiment and the modification examples described above and the effects thereof are described.

An adjustment sheet is an adjustment sheet used in a recording device. The recording device includes a transport unit configured to transport a medium in a transport direction, a discharge unit configured to discharge a liquid droplet on a recording surface of the medium transported by the transport unit, and a detection unit configured to detect an image formed on the recording surface of the medium transported by the transport unit. The adjustment sheet is configured to be transported, when the adjustment sheet is set on the recording surface of the medium, together with the medium in the transport direction by the transport unit. The adjustment sheet includes a first surface configured to contact the recording surface, and a second surface being a surface located opposite to the first surface and including an adjustment region being a region configured to be formed with an adjustment pattern detectable by the detection unit. A prescribed pattern has been formed in a region different from the adjustment region on the second surface.

According to the above-described configuration, by setting the adjustment sheet on the medium such that the first surface contacts the recording surface of the medium, the recording device can transport the adjustment sheet together with the medium in the transport direction. As a result, the second surface of the adjustment sheet can face the discharge unit of the recording device. In this way, the prescribed pattern that has been formed on the second surface can be detected by the detection unit of the recording device. In other words, whether or not setting of the adjustment sheet on the medium is forgotten may be determined by the recording device side depending on whether or not the prescribed pattern has been detected by the detection unit.

Then, in a state where the adjustment sheet is set on the medium, the adjustment pattern can be formed in the adjustment region of the adjustment sheet by discharging a liquid droplet from the discharge unit. Then, the adjustment pattern formed in the adjustment region is read by the recording device side, and thus the recording device can perform correction using this adjustment pattern.

Here, in order to record the adjustment pattern on the adjustment sheet, a liquid droplet discharged from the discharge unit lands on the adjustment sheet. Then, by landing the liquid droplet onto the adjustment sheet, wrinkling and cockling may also be generated in the adjustment sheet.

For correction, it is assumed that the adjustment pattern is formed on the adjustment sheet described above instead of the medium. In this case, variations in the generation aspect of wrinkling and cockling in a sheet used for correction are suppressed. As a result, variations in correction accuracy due to a type of the sheet on which the adjustment pattern is formed can be suppressed.

The recording device includes the detection unit configured to move in scanning directions intersecting the transport direction among directions along the recording surface of the medium transported by the transport unit, and the detection unit is configured to output a signal according to a density of the image on the recording surface. In this case, the prescribed pattern might have been formed such that a first portion and a second portion are aligned adjacent to each other. Here, the second portion has a density lower than that of the first portion.

It is also conceivable that the prescribed pattern is a single thick line. In this case, it is difficult to distinguish the prescribed pattern from a line formed on the second surface of the adjustment sheet apart from the prescribed pattern. In this regard, in the above-described configuration, the prescribed pattern including the first portion and the second portion having different densities from each other is formed on the second surface. Therefore, by using the detection unit of the recording device, even when a line is formed on the second surface in addition to the prescribed pattern, this line is easily distinguished from the prescribed pattern.

In the above-described adjustment sheet, the prescribed pattern may be configured to include the first portion and the second portion being aligned in a first direction among directions along the second surface, and the prescribed pattern may extend in a direction different from the first direction among directions along the second surface.

It is assumed that the adjustment sheet is set on the medium such that the scanning direction of the detection unit substantially matches the first direction, and in this state, the adjustment sheet is transported together with the medium in the transport direction. According to the above-described configuration, when the adjustment sheet is transported together with the medium in the transport direction, a direction in which the prescribed pattern extends includes a component of the transport direction. In this way, even in a case where the medium is transported in the transport direction, the prescribed pattern can be continuously read by the detection unit. Therefore, an occurrence of a detection error such that the prescribed pattern cannot be read by the detection unit can be suppressed in comparison to a case where the prescribed pattern is interrupted partway. Note that, in this case, an interval between the first portion and the second portion being aligned in a direction different from the first direction may be less than or equal to a detection resolution of the detection unit. In this way, when the detection unit detects the prescribed pattern, the recording device can recognize that the first portion and the second portion are continuous, and thus an effect of suppressing the occurrence of the detection error described above can be increased.

In the above-described adjustment sheet, as the prescribed pattern, a first prescribed pattern and a second prescribed pattern might have been formed on the second surface, the second prescribed pattern has been formed at a position different from that of the first prescribed pattern in the first direction and, when a second direction is defined as a direction orthogonal to the first direction among directions along the second surface, in the second direction, one end of both ends of the first prescribed pattern might have been disposed at the same position as one end of both ends of the second prescribed pattern, and in the second direction, the other end e of both ends of the first prescribed pattern might have been disposed in the same position as a position of the other end of both ends of the second prescribed pattern.

Even when the adjustment sheet is set on the medium such that the scanning direction of the detection unit substantially matches the first direction, the medium may be slanted during transport. With the adjustment sheet having the above-described configuration being set on the medium, when the medium is slanted, one pattern of the first prescribed pattern and the second prescribed pattern can be read by the detection unit that moves in the scanning direction, but the other pattern may not be able to be read. In such a case, whether or not the medium is slanted can be determined by reading the prescribed pattern by the detection unit.

In the above-described adjustment sheet, as the prescribed pattern, a first prescribed pattern and a second prescribed pattern might have been formed on the second surface, the second prescribed pattern have been formed at a position different from a position of the first prescribed pattern in the first direction, the first prescribed pattern and the second prescribed pattern might have been each disposed such that at least a part of the first prescribed pattern overlaps with at least a part of the second prescribed pattern in the first direction, and, when a second direction is defined as a direction orthogonal to the first direction among directions along the second surface, the first prescribed pattern and the second prescribed pattern might have been each formed such that a distance between the first prescribed pattern and the second prescribed pattern in the first direction, varies in the second direction.

In the recording device, a gap between the first prescribed pattern and the second prescribed pattern can be detected by reading the first prescribed pattern and the second prescribed pattern by the detection unit while the adjustment sheet is transported together with the medium.

In the above-described configuration, the prescribed pattern is formed to have a distance between the first prescribed pattern and the second prescribed pattern in the first direction to vary in the second direction. For this reason, a gap between the first prescribed pattern and the second prescribed pattern detected by the recording device gradually changes as the adjustment sheet is transported together with the medium. Thus, by monitoring the above-described gap changing in such a manner, a transport speed of the medium and the adjustment sheet by the recording device can be estimated.

In the above-described adjustment sheet, the adjustment region might have been disposed between the first prescribed pattern and the second prescribed pattern in the first direction.

According to the above-described configuration, when the adjustment pattern is recorded on the adjustment sheet, it is easy to determine which position on the second surface of the adjustment sheet a liquid droplet should land.

In the above-described adjustment sheet, as the prescribed pattern, a first prescribed pattern and a second prescribed pattern might have been formed on the second surface, the second prescribed pattern have been formed at a position different from a position of the first prescribed pattern, the adjustment region might have been disposed between the first prescribed pattern and the second prescribed pattern, and, when a first direction is defined as a direction in which the first prescribed pattern, the adjustment region, and the second prescribed pattern are aligned, among directions along the second surface, the first prescribed pattern and the second prescribed pattern may each extend in a direction different from the first direction among directions along the second surface.

According to the above-described configuration, when the adjustment pattern is recorded on the adjustment sheet, it is easy to determine which position on the second surface of the adjustment sheet a liquid droplet should land.

It is assumed that the adjustment sheet is set on the medium such that the scanning direction of the detection unit substantially matches the first direction, and in this state, the adjustment sheet is transported together with the medium in the transport direction. According to the above-described configuration, when the adjustment sheet is transported together with the medium in the transport direction, a direction in which the first prescribed pattern extends and a direction in which the second prescribed pattern extends each include a component of the transport direction. Thus, the detection unit can be prevented from forgetting to read the first prescribed pattern and the second prescribed pattern formed on the adjustment sheet transported in the transport direction together with the medium.

The above-described adjustment sheet further includes a body sheet including the second surface, and an adhesive layer provided on a surface of the body sheet opposite to the second surface. the first surface is an outermost surface of the adhesive layer.

According to the above-described configuration, the adjustment sheet can be attached to the medium by adhesion of the adhesive layer.

An adjusting method of a landing position of a liquid droplet includes: providing a recording device comprising a transport unit configured to transport a medium, a discharge unit configured to discharge a liquid droplet on the medium transported by the transport unit while the discharge unit moves in scanning directions intersecting a transport direction of the medium in the transport unit, and a detection unit configured to detect an image formed on the recording surface of the medium while the detection unit moves in the scanning directions; setting the adjustment sheet described above on the medium; forming, after setting the adjustment sheet, the adjustment pattern including a forward direction pattern formed by discharging, on the adjustment region of the adjustment sheet transported together with the medium in the transport direction by the transport unit, a liquid droplet from the discharge unit while the discharge unit moves in a forward direction of the scanning directions, and a return direction pattern formed by discharging, on the adjustment region of the adjustment sheet, a liquid droplet from the discharge unit while the discharge unit moves in a return direction of the scanning directions; reading, after forming the adjustment pattern, the adjustment pattern by the detection unit; and calculating, after reading the adjustment pattern, a correction value for an adjustment of a discharge timing of a liquid droplet from the discharge unit based on the forward direction pattern and the return direction pattern.

According to the above-described configuration, the adjustment pattern including the forward direction pattern and the return direction pattern is formed in the adjustment region of the adjustment sheet set on the medium. Then, a correction value for an adjustment of a discharge timing of the discharge unit can be derived based on the amount of deviation between the forward direction pattern and the return direction pattern. Then, the discharge timing of the liquid droplet by the discharge unit is controlled by using the derived correction value, and thus the quality of an image formed on the medium can be increased.

In the adjusting method of a landing position of a liquid droplet, may comprise: adjusting, while calculating the correction value, a discharge timing of a liquid droplet from the discharge unit based on the forward direction pattern, the return direction pattern, and a thickness of the adjustment sheet.

According to the above-described configuration, the discharge timing of the liquid droplet from the discharge unit and the discharge timing of the liquid droplet during movement of the discharge unit in the return direction can be adjusted with consideration given to a thickness of the adjustment sheet.

What is claimed is:

1. An adjustment sheet used in a recording device, the recording device including a transport unit configured to transport a medium in a transport direction, a discharge unit configured to discharge a liquid droplet on a recording surface of the medium transported by the transport unit, and a detection unit configured to detect an image formed on the recording surface of the medium transported by the transport unit, the adjustment sheet being configured to be transported, when the adjustment sheet is set on the recording surface of the medium, together with the medium in the transport direction by the transport unit, the adjustment sheet comprising:

a first surface configured to contact the recording surface;

a second surface that is a surface located on a side opposite to the first surface and that includes an adjustment region being a region configured to be formed with an adjustment pattern detectable by the detection unit; and a prescribed pattern provided in a region on the second surface that is different from the adjustment region on the second surface.

2. The adjustment sheet according to claim 1, wherein in the recording device, the detection unit is configured to move in scanning directions intersecting the transport direction among directions along the recording surface of the medium transported by the transport unit, and the detection unit is configured to output a signal according to a density of the image on the recording surface, and the prescribed pattern has been formed such that a first portion and a second portion are aligned adjacent to each other, the second portion has a density lower than that of the first portion.

3. The adjustment sheet according to claim 2, wherein the prescribed pattern is configured with the first portion and the second portion being aligned in a first direction among directions along the second surface, and the prescribed pattern extends in a direction different from the first direction among directions along the second surface.

4. The adjustment sheet according to claim 2, wherein as the prescribed pattern, a first prescribed pattern and a second prescribed pattern have been formed on the second surface, the second prescribed pattern has been formed at a position different from a position of the first prescribed pattern in the first direction and, when a second direction is defined as a direction orthogonal to the first direction among directions along the second surface, in the second direction, one end of both ends of the first prescribed pattern has been disposed at the same position as one end of both ends of the second prescribed pattern, and in the second direction, the other end of both ends of the first prescribed pattern has been disposed at the same position the other end of both ends of the second prescribed pattern.

5. The adjustment sheet according to claim 2, wherein as the prescribed pattern, a first prescribed pattern and a second prescribed pattern have been formed on the second surface, the second prescribed pattern have been formed at a position different from a position of the first prescribed pattern in the first direction, the first prescribed pattern and the second prescribed pattern have been each disposed such that at least a part of the first prescribed pattern overlaps with at least a part of the second prescribed pattern in the first direction and, when a second direction is defined as a direction orthogonal to the first direction among directions along the second surface, the first prescribed pattern and the second prescribed pattern have been each formed such that a distance between the first prescribed pattern and the second prescribed pattern in the first direction, varies in the second direction.

6. The adjustment sheet according to claim 4, wherein the adjustment region has been disposed, in the first direction, between the first prescribed pattern and the second prescribed pattern.

7. The adjustment sheet according to claim 1, wherein as the prescribed pattern, a first prescribed pattern and a second prescribed pattern have been formed on the second surface, the second prescribed pattern have been formed at a position different from a position of the first prescribed pattern, the adjustment region has been disposed between the first prescribed pattern and the second prescribed pattern, and, when a first direction is defined as a direction in which the first prescribed pattern, the adjustment region, and the second prescribed pattern are aligned, among directions along the second surface, the first prescribed pattern and the second prescribed pattern each extend in a direction different from the first direction among directions along the second surface.

8. The adjustment sheet according to claim 1, comprising:

a body sheet including the second surface; and an adhesive layer provided on a surface on a side of the body sheet opposite to the second surface, wherein the first surface is an outermost surface of the adhesive layer.

9. An adjusting method of a landing position of a liquid droplet comprising:

providing a recording device comprising a transport unit configured to transport a medium, a discharge unit configured to discharge a liquid droplet on the medium transported by the transport unit while the discharge unit moves in scanning directions intersecting a transport direction of the medium in the transport unit, and a detection unit configured to detect an image formed on the recording surface of the medium while the detection unit moves in the scanning directions;

setting an adjustment sheet on the medium, the adjustment sheet being configured to be transported, when the adjustment sheet is set on the recording surface of the medium, together with the medium in the transport direction by the transport unit, the adjustment sheet comprising:

a first surface configured to contact the recording surface; and a second surface that is a surface located on a side opposite to the first surface and that includes an adjustment region being a region configured to be formed with an adjustment pattern detectable by the detection unit, wherein a prescribed pattern is formed in a region different from the adjustment region on the second surface;

forming, after setting the adjustment sheet, the adjustment pattern including:

a forward direction pattern formed by discharging, on the adjustment region of the adjustment sheet transported together with the medium in the transport direction by the transport unit, a liquid droplet from the discharge unit while the discharge unit moves in a forward direction of the scanning directions and a return direction pattern formed by discharging, on the adjustment region of the adjustment sheet, a liquid droplet from the discharge unit while the discharge unit moves in a return direction of the scanning directions;

reading, after forming the adjustment pattern, the adjustment pattern by the detection unit; and calculating, after reading the adjustment pattern, a correction value for an adjustment of a discharge timing of a liquid droplet from the discharge unit based on the forward direction pattern and the return direction pattern.

10. The adjusting method of a landing position of a liquid droplet according to claim 9, comprising:

adjusting, while calculating the correction value, a discharge timing of a liquid droplet from the discharge unit based on the forward direction pattern, the return direction pattern, and a thickness of the adjustment sheet.

11. An adjustment sheet used in a recording device, the recording device including a transport unit configured to transport a medium in a transport direction, a discharge unit configured to discharge a liquid droplet on a recording surface of the medium transported by the transport unit, and a detection unit configured to detect an image formed on the recording surface of the medium transported by the transport unit, the adjustment sheet being configured to be transported, when the adjustment sheet is set on the recording surface of the medium, together with the medium in the transport direction by the transport unit, the adjustment sheet comprising:

a first surface configured to contact the recording surface; and a second surface that is a surface located on a side opposite to the first surface and that includes an adjustment region being a region configured to be formed with an adjustment pattern detectable by the detection unit, wherein a prescribed pattern has been formed in a region on the second surface that is different from the adjustment region on the second surface, in the recording device, the detection unit is configured to move in scanning directions intersecting the transport direction among directions along the recording surface of the medium transported by the transport unit, and the detection unit is configured to output a signal according to a density of the image on the recording surface, as the prescribed pattern, a first prescribed pattern and a second prescribed pattern have been formed on the second surface, the second prescribed pattern has been formed at a position different from a position of the first prescribed pattern in the first direction and, when a second direction is defined as a direction orthogonal to the first direction among directions along the second surface, in the second direction, one end of both ends of the first prescribed pattern has been disposed at the same position as one end of both ends of the second prescribed pattern, and in the second direction, the other end of both ends of the first prescribed pattern has been disposed at the same position the other end of both ends of the second prescribed pattern.

12. The adjustment sheet according to claim 11, wherein the prescribed pattern is formed such that a first portion and a second portion are aligned adjacent to each other, the second portion having a density lower than that of the first portion.

* * * * *